US007475478B2

(12) United States Patent
McCrink et al.

(10) Patent No.: US 7,475,478 B2
(45) Date of Patent: Jan. 13, 2009

(54) METHOD FOR MANUFACTURING AUTOMOTIVE STRUCTURAL MEMBERS

(75) Inventors: Edward J. McCrink, Escondido, CA (US); Danny Codd, Escondido, CA (US)

(73) Assignee: KVA, Inc., Rancho Santa Fe, CA (US)

( * ) Notice: Subject to any disclaimer, the term of this patent is extended or adjusted under 35 U.S.C. 154(b) by 172 days.

(21) Appl. No.: 11/519,331

(22) Filed: Sep. 11, 2006

(65) Prior Publication Data

US 2007/0006461 A1 Jan. 11, 2007

Related U.S. Application Data

(63) Continuation-in-part of application No. 10/519,910, filed as application No. PCT/US02/20888 on Jul. 1, 2002, now abandoned.

(60) Provisional application No. 60/301,970, filed on Jun. 29, 2001.

(51) Int. Cl.

| | |
|---|---|
| ***B21D 53/88*** | (2006.01) |
| ***C21D 1/56*** | (2006.01) |
| ***C21D 8/00*** | (2006.01) |
| ***C21D 9/08*** | (2006.01) |
| ***C21D 9/52*** | (2006.01) |
| ***C22C 38/52*** | (2006.01) |

(52) U.S. Cl. ..... 29/897.2; 148/606; 148/607; 148/608; 148/609; 148/592; 148/593; 148/594; 148/597; 420/38

(58) Field of Classification Search ..... 29/897.2; 148/606–609, 592–594, 597; 420/38
See application file for complete search history.

(56) References Cited

U.S. PATENT DOCUMENTS 2,482,097 A * 9/1949 Clarke ..... 148/578

(Continued)

FOREIGN PATENT DOCUMENTS

JP 04-191319 9/1992

(Continued)

OTHER PUBLICATIONS

T.G. Gooch, Welding metallurgy of stainless steel. pp. 77-78; J. Gordon Parr. An introduction to Stainless Steel. 1965. Allegheny Ludlum Steel Corp. (Stainless Steel Handbook) Claud Bagger, et al. Induction het treatment of laser welds. vol. 15, No. 4, Nov. 2003. N. Irvine Saz. Hawley's Condensed Chemical Dictionary. 11th Edition.

(Continued)

*Primary Examiner*—David P Bryant
*Assistant Examiner*—Alexander P Taousakis
(74) *Attorney, Agent, or Firm*—Russo & Duckworth, LLP

(57) ABSTRACT

A method for making structural automotive components and the like includes providing a blank of air hardenable martensitic stainless steel in the annealed condition. The steel blank has a thickness in the range of 0.5-5.0 mm., and is formed utilizing stamping, forging, pressing, or roller forming techniques or the like into the form of an automotive structural member. The automotive structural member is then hardened by application of heat, preferably to between 950° C. and 1100° C. for standard martensitic stainless steels. Thereafter, the automotive structural member is preferably cooled at a rate greater than 25° C. per minute to achieve a Rockwell C hardness of at least 39. The automotive structural member may undergo additional heat treating processes including high temperature or low temperature tempering processes which may incorporate electro-coating.

15 Claims, 6 Drawing Sheets

U.S. PATENT DOCUMENTS

| | | | | | |
|---|---|---|---|---|---|
| 3,807,715 | A | | 4/1974 | Nelson | 266/5 F |
| 4,188,419 | A | | 2/1980 | Detert | 427/287 |
| 4,413,039 | A | | 11/1983 | Higuchi | 428/643 |
| 4,461,679 | A | | 7/1984 | Higuchi | 204/27 |
| 4,824,491 | A | * | 4/1989 | Tanaka et al. | 148/597 |
| 4,966,751 | A | | 10/1990 | Kaede | 420/34 |
| 5,178,693 | A | * | 1/1993 | Miyakusu et al. | 148/580 |
| 5,323,265 | A | | 6/1994 | Fujie | 359/507 |
| 5,370,751 | A | | 12/1994 | von Hagen | 148/330 |
| 5,433,801 | A | * | 7/1995 | Althaus et al. | 148/578 |
| 5,464,273 | A | * | 11/1995 | Makoto | 297/232 |
| 5,485,948 | A | | 1/1996 | McCrink | 228/126 |
| 5,512,237 | A | * | 4/1996 | Stigenberg | 420/49 |
| 5,558,317 | A | | 9/1996 | Nels | 267/156 |
| 5,770,832 | A | | 6/1998 | Carnes et al. | 219/109 |
| 5,871,140 | A | | 2/1999 | McCrink | 228/132 |
| 6,235,407 | B1 | | 5/2001 | Ogata | 428/626 |
| 6,645,318 | B2 | | 11/2003 | Takahashi | 148/325 |
| 6,673,472 | B2 | | 1/2004 | Maki | 428/653 |
| 6,676,777 | B2 | | 1/2004 | Kimura et al. | 148/529 |
| 6,718,932 | B1 | | 4/2004 | Cecur | 123/188.3 |
| 6,730,407 | B2 | | 5/2004 | Mori | 428/425.8 |
| 6,786,981 | B2 | | 9/2004 | Yazawa | 148/325 |
| 6,814,820 | B2 | | 11/2004 | Ozbaysal | 148/671 |
| 6,905,041 | B1 | | 6/2005 | Taketsu | 220/562 |
| 6,935,529 | B2 | | 8/2005 | Ishikawa | 220/562 |
| 2001/0030004 | A1 | | 10/2001 | Kushda | 148/325 |
| 2002/0109024 | A1 | | 8/2002 | Molnar | 239/585.1 |
| 2003/0025341 | A1 | | 2/2003 | Kollaritsch | 293/102 |
| 2003/0138342 | A1 | | 7/2003 | Hirasawa | 420/38 |
| 2004/0234715 | A1 | | 11/2004 | Gandy | 428/36.9 |
| 2004/0262930 | A1 | | 12/2004 | Cumming | 293/120 |
| 2006/0113011 | A1 | | 6/2006 | Tanida | 148/592 |
| 2006/0130940 | A1 | | 6/2006 | Kollaritsch | 148/518 |

FOREIGN PATENT DOCUMENTS

| | | |
|---|---|---|
| JP | 2002137086 | 5/2002 |
| JP | 2002 301577 | 10/2002 |
| WO | PCT/US02/02888 | 7/2002 |

OTHER PUBLICATIONS

Naoshi Ayukawa, et al. Development of weldable martensitic stainless steel line pipe by HF-ERW process. Stainless Steel World 1999.

* cited by examiner

METHOD FOR MANUFACTURING AUTOMOTIVE STRUCTURAL MEMBERS

RELATED APPLICATIONS

This application is a continuation-in-part application of U.S. application Ser. No. 10/519,910 filed on Dec. 30, 2004, now abandoned, which is in turn, a National Phase application of International Application Ser. No. PCT/US02/20888 filed on Jul. 1, 2002, which in turn, claims priority to U.S. Provisional Application No. 60/301,970 filed on Jun. 29, 2001.

BACKGROUND OF THE INVENTION

The present invention relates to automotive structural members for automobiles and trucks. More particularly, the present invention relates to a method of manufacturing original equipment and after-market automotive structural members such as vehicle pillars, sub-frames, cross beams, frame rails, frame brackets, roof rails, seat frames, door beams, bumper beams, control arms, wheels, instrument panel reinforcements, running boards, roll-bars, tow hooks, bumper hitches, or roof racks.

It is preferred that automotive structural members be lightweight to provide improved fuel economy, and of a sufficient strength and durability to meet automotive safety requirements. In addition, automotive structural members must be able to contend with harsh environmental conditions, and thus must be corrosion resistant.

In cost-sensitive applications such as automobiles, conventional engineering materials force a trade-off between cost and fuel efficiency, safety, and performance. Consequently, the typical vehicle tends to have a frame that is both too heavy and too weak. A heavy frame requires a more powerful engine, which leads to higher fuel consumption and higher emissions. The more powerful propulsion system is itself more expensive to build, uses more material, requires more energy to produce and leads to more emissions related to its manufacture. Conversely, a lightweight weak frame compromises the durability of the vehicle and the safety of its occupants.

Unfortunately, present day automotive structural members are still undesirably heavy and expensive to manufacture. For example, the automotive industry has recently introduced new alloys into automotive structures to improve hardness in an effort to reduce weight by reducing material. Furthermore, complicated and expensive coatings and heat treatments has been introduced to improve the characteristics of corrosion resistance, hardness, tensile strength, and toughness. Examples include efforts described in U.S. patent application No. 2006/0130940 which describes a nickel coating process for automotive components, and U.S. Pat. No. 6,475,307 which describes a method of manufacturing automotive components of stainless maraging steel. Several attempts have also been made to selectively harden only portions of automotive structural members, such as described in U.S. Pat. No. 5,868,456 and U.S. Patent Application No. 2003/0025341.

Unfortunately, all of the aforementioned attempts at manufacturing structural automotive components still suffer from various drawbacks. For example, prior manufacturing processes are either too expensive or produce automotive structural members having characteristics which are less than desirable such as a lack of hardness, durability, corrosion resistance, etc. As graphically depicted in FIG. 1, structural materials are currently available in a broad range of strength-to-weight ratios, or specific strengths, but the costs of these materials generally increase disproportionately to their specific strengths. Carbon composites and titanium, for example, while being perhaps ten times stronger than mild steel for a given weight, are typically more than fifty times more expensive when used to bear a given load. Consequently, such high performance materials are typically used only in on small items or in applications where the high cost is justified, such as in aircraft.

Conventionally, automotive structural members are manufactured from non-air hardenable steels. A rare exception of this is boron steel which provides high strength but it is not particularly corrosion resistant. Furthermore, the use of boron steel for automotive structural members typically requires implementing unwanted and expensive manufacturing steps to remove scale resulting from the hot-stamping hardening process.

An example of a non-air hardenable steel currently used in manufacturing is 4130 steel (UNS G10220). This steel does not crack when formed. However, it must be liquid-quenched after heat-treating to attain a high strength and unfortunately this liquid quenching tends to induce high levels of distortion. As a result, liquid quenched materials like 4130 have limitations when used for applications requiring frame-type structures that must be straight and free from distortion. Theoretically, the highest strength-to-weight ratio would be attained if parts of 4130 steel could be assembled together and then heated and liquid quenched as a whole, resulting in a frame with uniformly high-strength throughout all areas. However, liquid quenching an entire frame or large automotive structural component at one time would distort it beyond acceptable limits.

An example of a partially air hardenable steel is 410S (UNS S41008), made available by Allegheny Ludlum of Pittsburgh, PA. 410S is a low carbon modification of 410 (UNS S41000). The low carbon level (0.08% maximum) of 410S prevents austenite formation upon heating, thereby preventing martensite formation upon cooling. This means that the metal doesn't crack during typical forming processes, but it also doesn't harden to a high strength condition. Automotive structural members comprised of 410S would lack the strength needed for load bearing applications.

Additional examples of partially air hardenable steel are True Temper OX Gold and Platinum series, produced by True Temper Sports, Inc. These is a non-stainless steels achieves a high strength without cracking due to the precise addition of expensive alloying components. These alloy steels are specially formulated to mitigate the difficulties inherent in the welding of air hardenable steel. Modifying the material to prevent cracking results in a material too expensive to justify for most structural applications.

As reflected in FIG. 2, air hardenable martensitic stainless steels have exceptionally strength, particularly compared to common metals such as aluminum and even titanium. Nevertheless, even though as shown in FIG. 1 such steels are relatively affordable. Experimentation with air hardenable stainless steel for automotive structural applications appears to have never been attempted due to the paradigm shift in thinking required to produce a high-strength automotive part. Historically, high-strength automotive applications relied on the evolutionary approach of forming ferrous alloys strip, in its final metallurgical microstructure, using successively higher strength steels as the raw material until either the strength targets were met or the part could not be formed due to the material's limitations.

Air hardening steels were first commercially developed for use in cutlery for their high hardness. Common air hardenable steels include martensitic stainless steels. As defined herein, and as understood by those skilled in the art, air hardenable martensitic stainless steels are essentially alloys of chromium and carbon that possess a body-centered-cubic (bcc) or body-centered-tetragonal (bct) crystal (martensitic) structure in the hardened condition. They are ferromagnetic and hardenable by heat treatment, and they are generally mildly corrosion resistant.

Air hardenable martensitic stainless steels include a relatively high carbon and chromium content compared to other stainless steels with a carbon content between 0.08% by weight and 0.75% by weight and a chromium content between 11.5% by weight and 18% by weight. As reflected in FIG. 3, air hardenable martensitic stainless steels have also been defined, and are understood by those skilled in the art, as having a nickel equivalent of between about 4 and 12 and having a chromium equivalent of between about 8 and 15.5, where nickel equivalent is equal to (% Ni+30×% C)+(0.5×% Mn) and chromium equivalent is equal to (% Cr+% Mo+(1.5×% Si)+(0.5×% Nb). Either or both of these definitions are acceptable for practicing the present invention. According to these standard definitions, standard air hardenable martensitic stainless steels include types 403, 410, 414, 416, 416Se, 420, 420F, 422, 431, and 440A-C.

The relatively high carbon and chromium content compared to other stainless steels results in steel with good corrosion resistance, due to the protective chromium oxide layer that forms on the surface, and the ability to harden via heat treatment to a high strength condition. Unfortunately, the high carbon and chromium also presents difficulties related to brittleness and cracking in welding, and accordingly martensitic stainless steel has been primarily used for cutting tools, surgical instruments, valve seats, and shears. Non-stainless air hardenable steels, which contain very high levels of carbon to allow the formation of a martensitic microstructure upon quenching, also present difficulties related to brittleness and cracking.

The use of air hardenable martensitic stainless steels for golf clubs and bicycle applications was introduced in U.S. Pat. No. 5,485,948 and further described in U.S. Pat. No. 5,871,140. These patents describe brazed tube structures that take advantage of the fact that air hardenable stainless steel can be simultaneously brazed and hardened in one heat treating operation. However, there is no suggestion as to how to use such a material for automotive structural members.

This ongoing lack of a strong and lightweight yet low cost automotive structural material is a main hindrance to the development of economically viable low emissions vehicles that can compare in performance, safety, comfort, and price to those powered by the typical internal combustion power system.

Thus, rather than resort to the use of expensive alloys, it would be beneficial to create a process that could utilize common, inexpensive, air hardenable steel to produce automotive structural members substantially free of cracks. Such a process would be even more beneficial if the material possessed the corrosion resistant properties of stainless steel.

Furthermore, it would be desirable for an improved method for manufacturing automotive structural members which are built strong and lightweight, yet are produced at a low costs.

SUMMARY OF THE INVENTION

The present invention is directed to a method of manufacturing automotive structural members such as pillars, subframes, cross beams, frame rails, frame brackets, roof rails, seat frames, door beams, bumper beams, control arms, wheels, instrument panel reinforcements, running boards, roll-bars, tow hooks, bumper hitches, and roof racks using air-hardenable martensitic stainless steel. Preferred air-hardenable martensitic stainless steels include types 410, 420 and 440.

In accordance with the invention, the method of manufacturing an automotive structural member includes providing a blank of air-hardenable martensitic stainless steel in the annealed condition having a thickness in the range of 0.5-5.0 mm. Preferably, the martensitic stainless steel blank is provided in a coil, strip or sheet form having a thickness of 0.5-5.0 mm. Of importance, the blank is also provided in the annealed condition, prepared in accordance with annealing processes known to those skilled in the art. Thereafter, the martensitic stainless steel blanks are formed by a variety of traditional forming processes including stamping, forging, pressing, roller forming, etc. to form an automotive structural member.

At this point in the manufacturing process, the formed automotive structural member may, or may not, be fastened together with other components to form an structural assembly. For example, the automotive structural member may be affixed to other components utilizing mechanical fasteners or welded to other components using arc, resistance, laser or solid state welding methods to create larger structures.

Alternatively, the automotive structural member may be welded to other components using Applicant's welding process described in parent application Ser. No. 11/143,848 which is incorporated herein in its entirety by reference. Briefly, preferably the welding process includes welding two surfaces together such as by using a gas tungsten arc welding process, commonly known as tungsten inert gas process (TIG) or gas tungsten arc welding (GTAW). Plasma arc welding or laser welding, or additional non-typical welding methods may also be employed. The weld zone temperature is then controlled using the secondary heat source which is preferably a torch assembly or induction coil assembly positioned adjacent to the weld immediately downstream of the weld box. The weld area is slow cooled at a rate slower than natural air cooling using the secondary heat source between the $A_3$ temperature, which is the upper critical temperature above which austenite is found, and the $A_1$, temperature, which is the lower critical temperature below which ferrite are carbide are stable. The cooling rate is dependent upon weld speed, wall thickness, alloy-type in ambient conditions. However, the secondary heat source provides heat at a sufficiently high temperature and maintains heat for sufficiently long so as to reduce the hardness of the weld.

After the steel blank has been formed into an automotive structural member, and optionally fastened to other components, the automotive structural member undergoes a hardening cycle to obtain a uniform, high strength condition throughout the part. The hardening cycle includes heating the automotive structural members to between 925° C. and 1200° C. More preferably, for standard air-hardenable martensitic stainless steels such as types 410, 420, and 440, the automotive structural member is heated to between 950° C. and 1100° C. The automotive structural members are heating to a temperature for a sufficiently long period so as to austenitize the structural member's entire microstructure.

The hardening cycle of the present invention further requires that the automotive structural member be air quenched at a sufficiently rapid rate so as to transform the steel into a predominantly martensitic microstructure. Ideally, the air quenching is conducted sufficiently quickly as to transform the steel into a 90-100% martensitic microstructure and 0-10% ferrite microstructure. This air cooling process must be done at a rate greater than 15° C. per minute for air-hardenable martensitic stainless steels and anticipated air hardenable stainless steel alloys. It is also aspect of the present invention that the hardening cycle hardens the automotive structural member to a Rockwell C hardness of at least 39 . To obtain a Rockwell C hardness of 39 or greater, air cooling of the automotive structural member is preferably conducted at a rate greater than 25° C. per minute for standard martensitic stainless steels including types 410, 420 and 440.

Subsequent to hardening, the automotive structural member may be capable of being used within an automobile or truck without further heat treatment. However, where improved ductility is desired, preferably the hardened structural member is subjected to a tempering process. Various tempering processes may be conducted as can be selected as those skilled in the art. In a preferred tempering process, the automotive structural member is heated to between 150° C. and 650° C. This subsequent heating of the part instills a substantial increase in ductility and corresponding decrease in brittleness without a substantial loss in the steel's hardness. Subsequent to the tempering process, the automotive structural member is allowed to air cool to ambient temperatures.

In an alternative tempering process, the automotive structural member is subjected to a low temperature tempering in which the part is heated to between 130° C. and 180° C. Ideally, this low temperature tempering operation is conducted during an electro-coating process in which the part is baked at between 130° C. and 180° C. for 20-30 minutes. The low temperature tempering/electro-coating bake cycle also reduces the brittleness and increases toughness and ductility without a substantial loss in hardness.

Advantageously, the manufactured automotive structural member has high strength, desirable toughness and ductility, and substantial corrosion resistance. Moreover, air-hardenable martensitic stainless steels are relatively inexpensive compared to many other steel alloys or composite materials which results in automotive structural members having improved functional properties at a reduced cost.

It is thus an object of the present invention to provide a high strength low cost process for manufacturing automotive structural members.

Other features and advantages of the present invention will be appreciated by those skilled in the art upon reading the detailed description which follows with reference to the attached drawings.

DETAILED DESCRIPTION OF THE INVENTION

Figure 1:
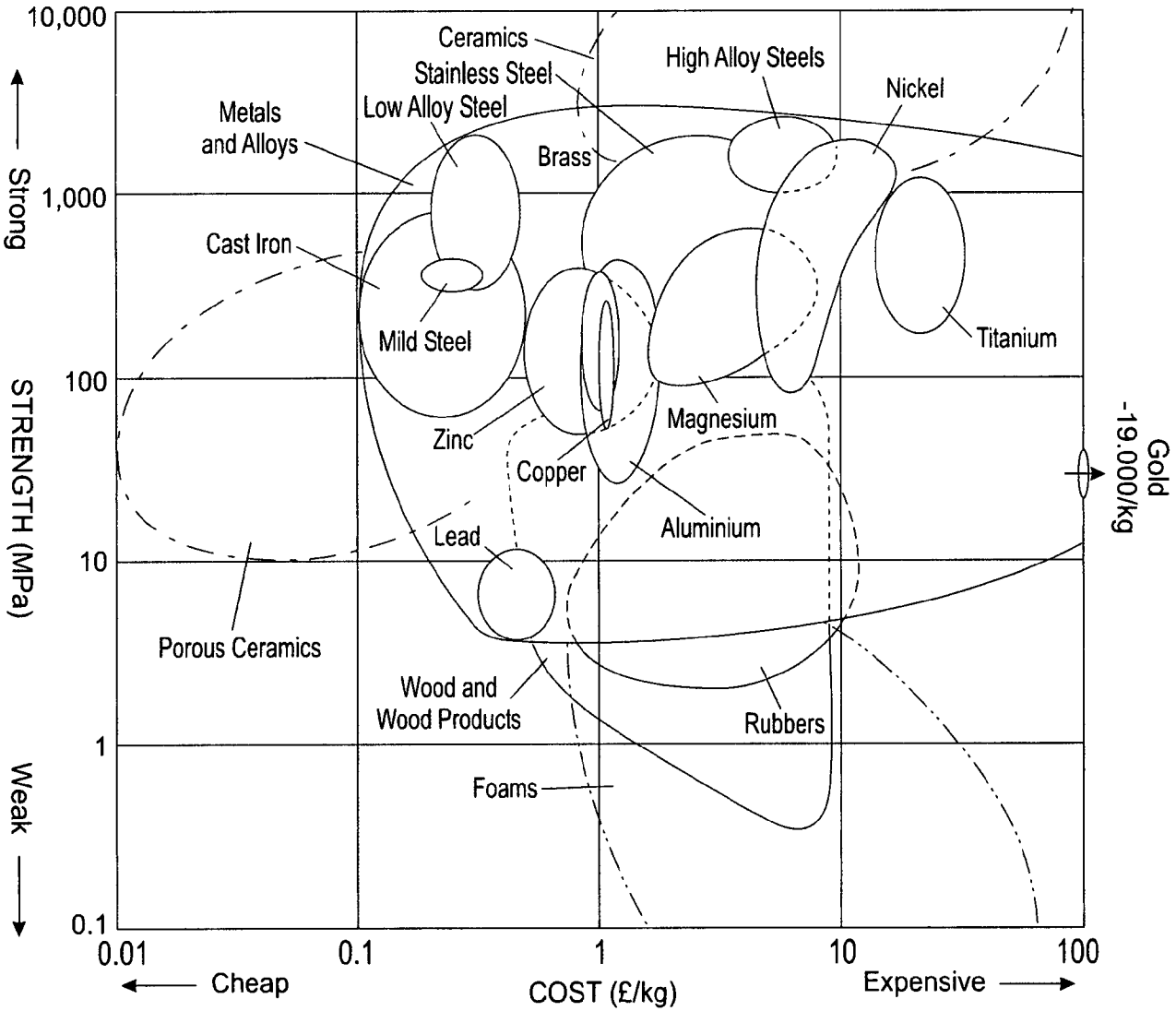
FIG. 1 is a chart illustrating relative strength/cost advantages of various materials.
Figure 2:
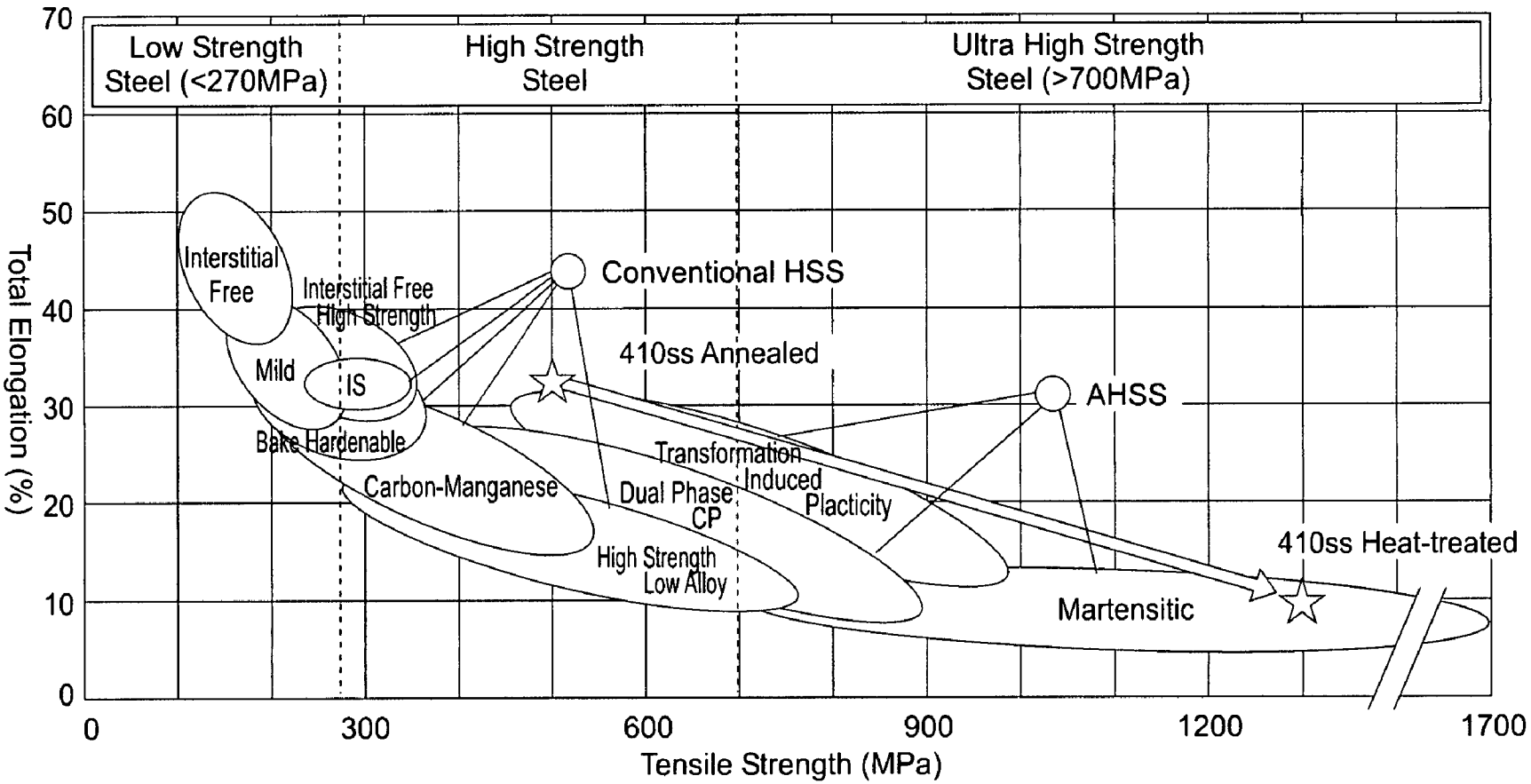
FIG. 2 is a chart illustrating relative strength advantages of various materials including martensitic stainless steel.
Figure 3:
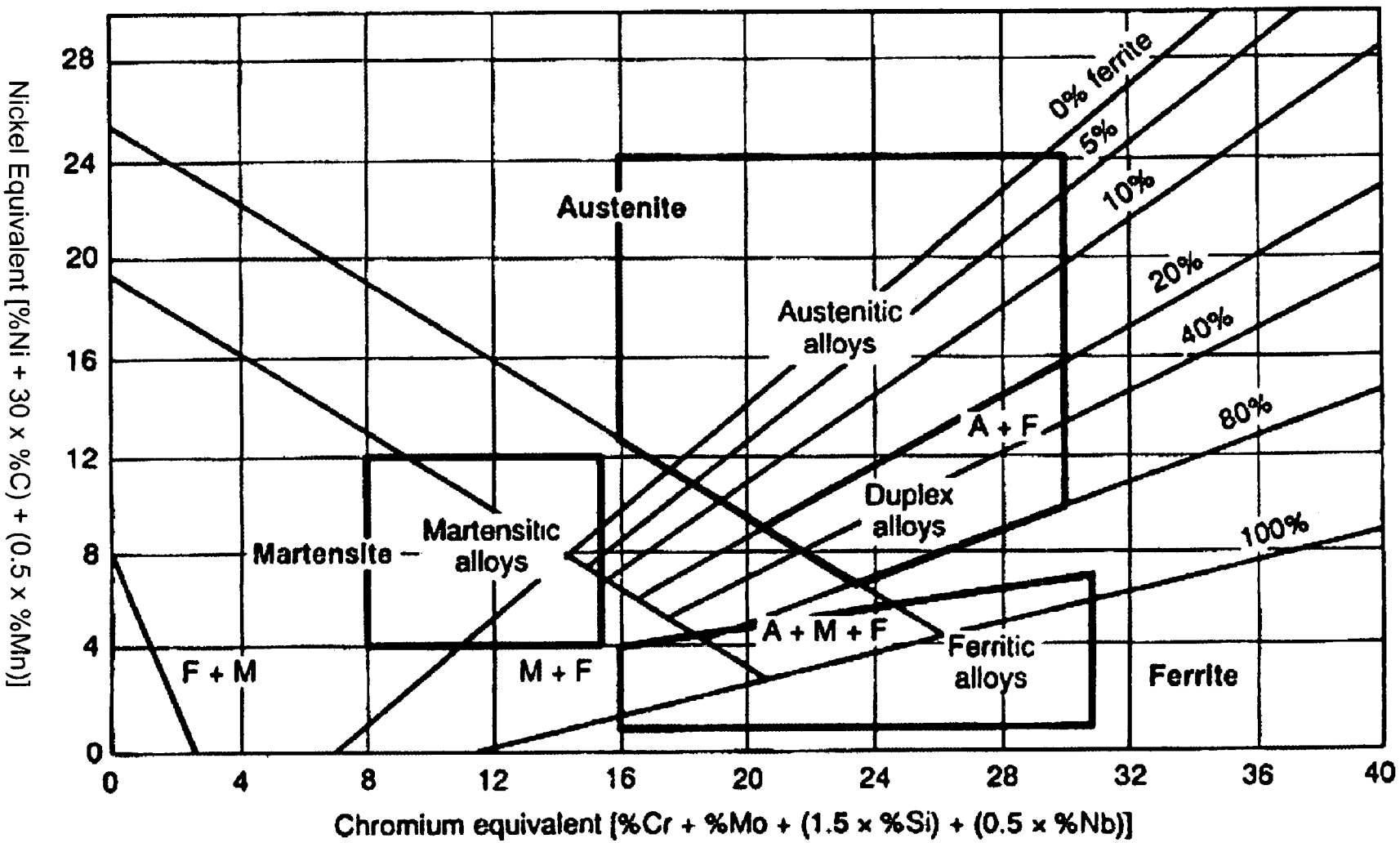
FIG. 3 is a chart illustrating a definition for martensitic stainless steel in terms of chromium equivalent and nickel equivalent.

While the present invention is susceptible of embodiment in its various forms, there is shown in the drawings and will be hereinafter be described the presently preferred embodiments of the invention with the understanding that the present disclosure is to be considered as exemplifications of the invention and it is not intended to limit the invention to the specific embodiments illustrated.

Figure 4:
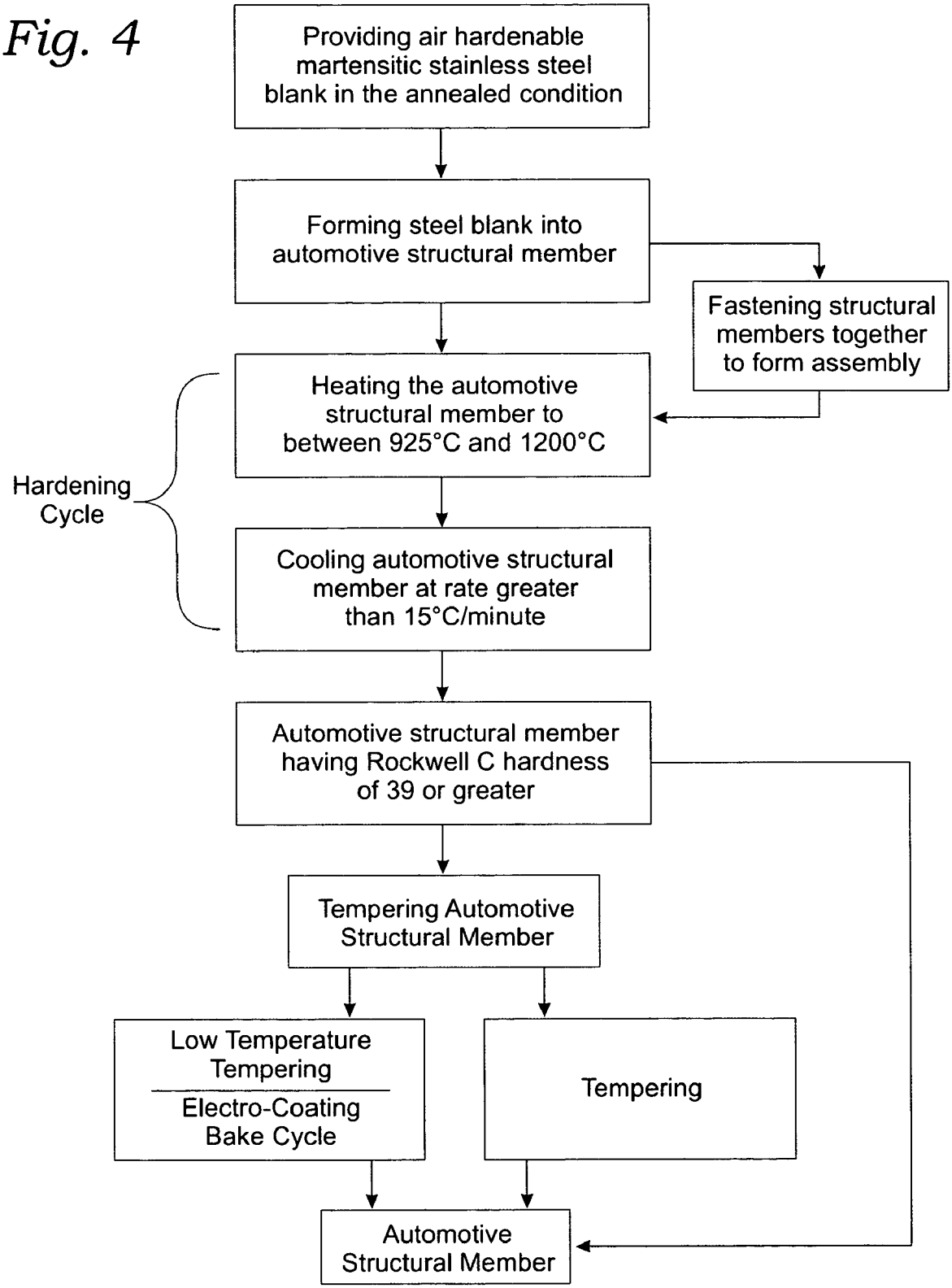
FIG. 4 is a flow chart illustrating the manufacturing process of the present invention for producing automotive structural members.
Figure 5:
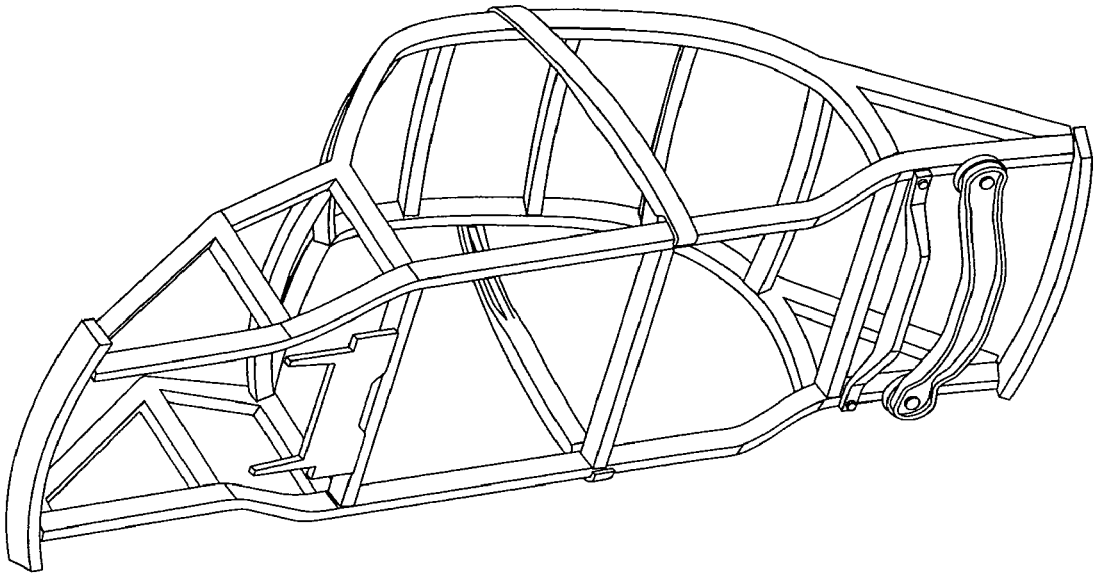
FIG. 5 is a perspective view illustrating vehicle structural members of the present invention.
Figure 6:
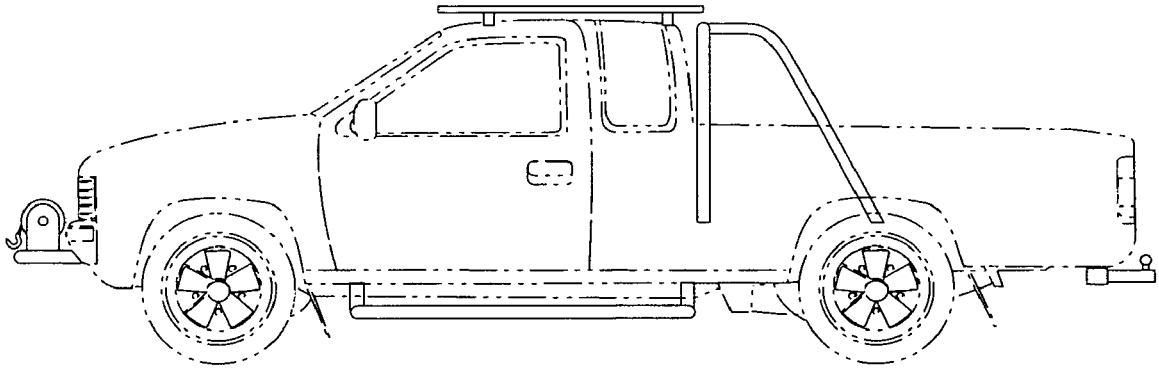
FIG. 6 is a perspective view illustrating typical after-market vehicle structural members of the present invention.

As illustrated in FIGS. 4-6, the present invention is directed to a method of manufacturing automotive structural members. The method of manufacturing automotive structural members is particularly useful for fabricating automotive pillars, sub-frames, cross beams, frame rails, frame brackets, roof rails, seat frames, door beams, bumper beams, control arms, wheels, instrument panel reinforcements, running boards, roll-bars, tow hooks, bumper hitches, and roof racks. In accordance with the invention, air hardenable martensitic stainless steel, preferably of types 410, 420 or 440, is provided in coil, strip or sheet form to provide a blank having a thickness of 0.5-5.0 mm. Preferably, the blank is provided in sheet form having a thickness in the range of 0.5-3.0 mm. The blanks are annealed, or provided in the annealed form, so as to have a microstructure consisting primarily of ferrite and chromium carbide compounds. Annealing of the martensitic steel results in a reduced hardness. For example, annealing type 410 martensitic stainless steel produces blanks having a Rockwell B hardness of 95, an elongation of 20% minimum, a 0.2% yield strength of 205 Mega-Pascals (MPa) minimum, and a tensile strength of 450 MPa minimum.

After being annealed, martensitic stainless steel blanks are then formed by conventional metal processing techniques including stamping, pressing, forging, roller forming, etc. to form a variety of automotive structural members. As shown in FIG. 5, preferred original equipment automotive structural members include pillars, sub-frames, cross beams, frame rails, frame brackets, roof rails, seat frames, door beams, bumper beams, control arms, wheels, and instrument panel reinforcements. The method fabricating automotive structural members of the present invention may also be used to produce after-market automotive structural members including running boards, roll-bars, tow hooks, bumper hitches, and roof racks as shown in FIG. 6.

Prior to further processing in accordance with the present invention, the automotive structural members may be fastened to other components, such as other automotive structural members to form an assembly. The fastening techniques may include simple mechanical fasteners such as the use of nuts and bolts, shear pins, or bracketry. Additionally, welding such as arc, resistance, laser, plasma or solid state welding methods may be used to create larger structural assemblies by combining vehicle structural members together. If welding is employed, care must be taken to not overly stress the weld and associated heat-affected-zones (HAZ) during handling as local hardening and brittleness may occur depending on the weld method and heat input employed.

Figure 7:
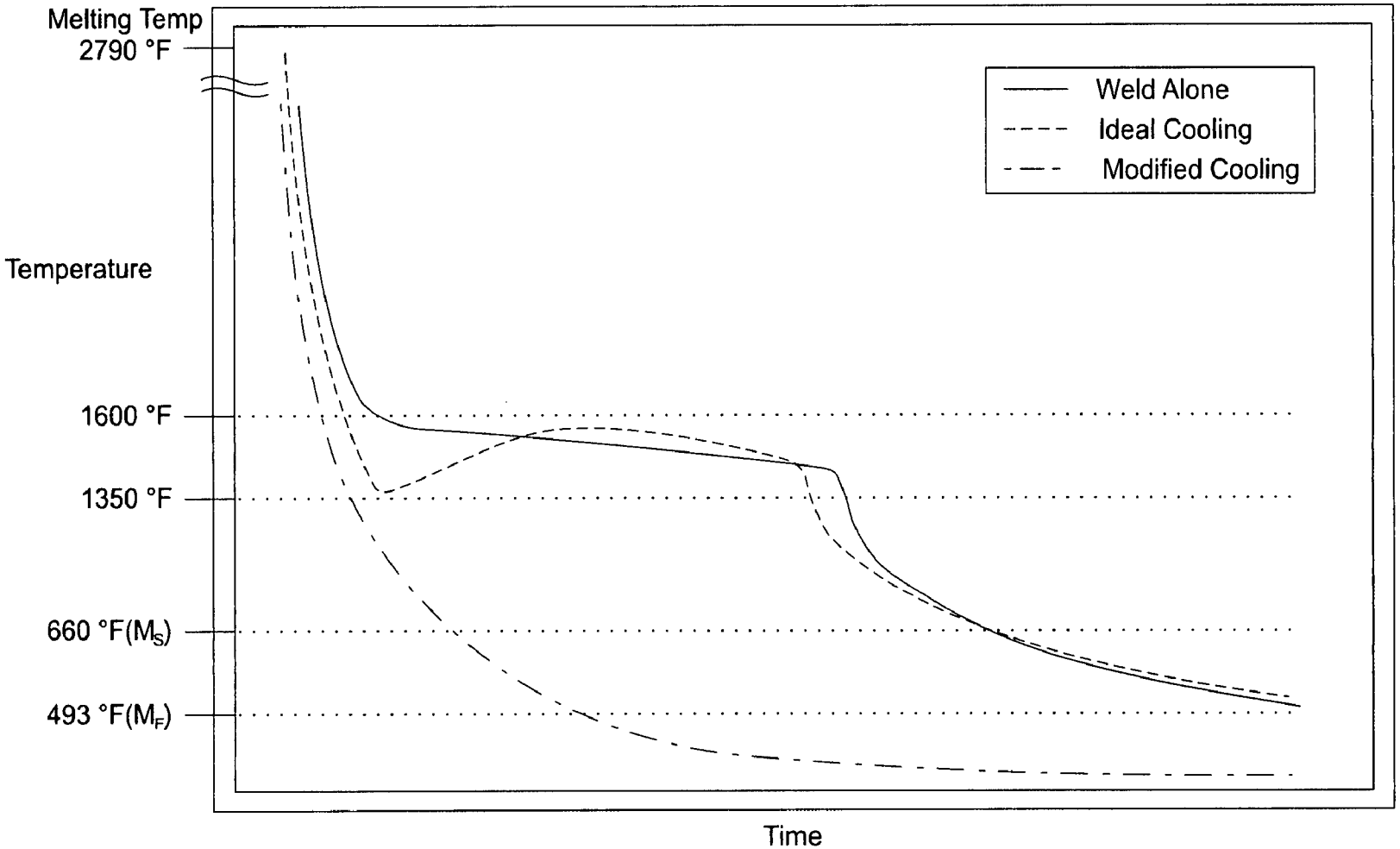
FIG. 7 is a chart illustrating the cooling profile using a preferred welding process.

In an effort to reduce the local hardening and brittleness in the weld zone, a secondary heat source may be utilized to apply heat locally to the welded metal immediately after the welding process. For this embodiment of the invention, heat may be applied to the weld area using any of a variety of localized heat sources including propane or oxyacetylene torches, or induction coils to provide heat to the weld, but not to the entire automotive structural component, such as provided by a furnace or oven. Preferably, as illustrated in FIG. 7, the heat from the secondary heat source is applied to the weld zone prior to the weld cooling below the lower critical temperature for air hardenable martensitic stainless steel. This heat is applied for a sufficiently long period and at a sufficiently high temperature so as to maintain the weld between the A3 temperature and the A1 temperature to thereby reduce the hardness of the weld. This slow cooling results in a temperature reduction which is much slower than natural air cooling, and is a reduction rate which is dependent upon a variety of factors including the material thicknesses, alloy type and ambient conditions.

As illustrated in FIG. 4, subsequent to forming the automotive structural member, the part proceeds through a two-step hardening cycle in order to obtain a uniform, high strength condition throughout the entire part. The hardening process is intended to provide a Rockwell C hardness of at least 39. To this end, the automotive structural member is first heated to between 925° C. and 1200° C. depending on the chemical composition of the air hardenable martensitic stainless steel. More preferably, for standard air hardenable stainless steel such as 410, 420 and 440, the automotive structural member is heated until the entire structural member has a temperature between 950° C. and 100° C., resulting in a microstructure which is substantially austenitic.

Ideally, the parts are heated using high-throughput continuous furnaces producing heat through gas, electric or induction heating apparatus. Furthermore, the furnaces preferably employ a roller hearth or continuous mesh belt which introduces a protective atmosphere of nitrogen, argon, hydrogen or disassociated ammonia to prevent oxidation of the automotive structural members. The term "protective atmosphere" as used herein may also describe other non-oxidizing atmospheres including vacuum furnaces. Temperatures will vary depending on the type of air hardenable martensitic stainless steel. As an example, for type 410 martensitic stainless steel, the entire part should be heated slightly above the steel's upper critical temperature to a range of 950° C. to 1100° C.

The second phase of the hardening cycle entails air quenching the automotive structural member at a rate so as to transform the steel into a predominantly martensitic microstructure. As defined herein, the term "air cooling" and "air quenching" is intended to be interpreted broadly so as to include the implementation of protective atmospheres within the furnace including nitrogen, argon and disassociated ammonia, but not include liquid quenching. Ideally, the air quenching is conducted sufficiently quickly so as to transform the steel into a 90-100% martensitic microstructure and a 0-10% ferritic microstructure. This air cooling process must be conducted at a rate greater than 15° C. per minute for typical air hardenable martensitic stainless steels and not-yet-developed air hardenable martensitic stainless steel alloys which may include chemical compositions permitting a relatively slow cooling rate. However, for standard air hardenable stainless steels such as 410, 420, and 440, preferably the air cooling process is conducted at the much faster rate of 25° C. per minute or greater. The cooling zone preferably includes water jackets to remove excess heat while a protective atmospheric gas circulates in the chamber to cool the automotive structural member.

Following the above example, the automotive structural member of type 410 martensitic stainless steel is air cooled at greater than 25° C. per minute. After air quenching, the automotive structural member of type 410 martensitic stainless steel exists in a fully hardened condition having a Rockwell C hardness of 40-44 and having a corresponding tensile strength of 1200-1500 MPa.

As illustrated in FIG. 4, the hardened automotive structural members may be employed in a vehicle without further heat treatment, where high strength is desired, and limited ductility and brittleness are not concerns. However, it is preferred that the automotive structural member be tempered, either through a high temperature tempering process or a low temperature tempering process prior to introduction of the part into an automotive vehicle.

In a preferred high temperature tempering process, the automotive structural member is heated to between 150° C. and 650° C. In a preferred low temperature tempering process, the automotive structural member is heated to between 130° C. and 180° C. This low temperature tempering process may be conducted simultaneously during an electro-coating process in which the automotive structural member is typically heating to between 130° C. and 180° C. for 20-30 minutes. Subsequent to heating, the automotive structural member is air quenched which results in the automotive structural member having a reduced brittleness and corresponding increased toughness and ductility, without a substantial loss in hardness or strength.

While several particular forms of the invention have been illustrated and described, it will be apparent to those skilled in the art that various modifications can be made without departing from the spirit and scope of the invention. Accordingly, it is not intended that the invention be limited except by the following claims.

We claim:

1. A method of manufacturing an automotive structural member comprising the steps of:

providing an air hardenable martensitic stainless steel blank in the annealed condition having a thickness in the range of 0.5-5.0 millimeters;

forming the steel blank while in the annealed condition to the form of an automotive structural member; and hardening the automotive structural member by heating the automotive structural member to between 925° C. and 1200° C. with heating being to at least above the upper critical $A_3$ temperature to form a substantially single phase of austenite for the air hardenable martensitic stainless steel blank; and subsequently air cooling the automotive structural member at a rate greater than 15° C./minute to harden the automotive structural member to a Rockwell C hardness of at least 39.

2. The method of manufacturing an automotive structural member of claim 1 wherein the automotive structural member is a pillar, sub-frame, cross beam, frame rail, frame bracket, roof-rail, seat frame, door beam, bumper beam, control arm, wheel, instrument panel reinforcement, running board, roll-bar, tow hook, bumper hitch, or roof rack.

3. The method of manufacturing an automotive structural member of claim 1 wherein the step of hardening the automotive structural member includes heating the automotive structural member to between 950° C. and 1100° C. and subsequently air cooling the automotive structural member at a rate greater than 25° C./minute.

4. The method of manufacturing an automotive structural member of claim 1 further comprising the steps of:

allowing the automotive structural member to reach equilibrium after hardening;

tempering the automotive structural member by heating the automotive structural member to between 150° C. and 650° C.; and allowing the automotive structural member to air cool to ambient temperatures.

5. The method of manufacturing an automotive structural member of claim 1 further comprising the steps of:

allowing the automotive structural member to reach equilibrium after hardening;

performing a low temperature tempering of the automotive structural member by heating the automotive structural member to between 130° C. and 180° C.; and allowing the automotive structural member to air cool to ambient temperatures.

6. The method of manufacturing an automotive structural member of claim 5 wherein the step of performing a low temperature tempering is accomplished during an electrocoating bake cycle.

7. The method of manufacturing an automotive structural member of claim 1 wherein the air hardenable martensitic stainless steel blank is type 410.

8. The method of manufacturing an automotive structural member of claim 1 wherein the air hardenable martensitic stainless steels blank is type 420.

9. The method of manufacturing an automotive structural member of claim 1 wherein the air hardenable martensitic stainless steel blank has a carbon content substantially equal or greater than 0.08% by weight and a chromium content substantially equal or greater than 11.5% by weight.

10. The method of manufacturing an automotive structural member of claim 1 wherein the air hardenable martensitic stainless steel blank has a carbon content substantially between 0.08% by weight and 0.75% by weight and a chromium content substantially between 11.5% by weight and 18% by weight.

11. A method of manufacturing an automotive structural member comprising the steps of:

providing an air hardenable martensitic stainless steel blank of type 410 or 420 in the annealed condition having a thickness in the range of 0.5-5.0 millimeters;

forming the steel blank while in the annealed condition to the form of an automotive structural member; and hardening the automotive structural member by heating the automotive structural member to between 950° C. and 1100° C. and subsequently air cooling the automotive structural member at a rate greater than 25° C./minute to harden the automotive structural member to a Rockwell C hardness of at least 39.

12. The method of manufacturing an automotive structural member of claim 11 wherein the automotive structural member is a pillar, sub-frame, cross beam, frame rail, frame bracket, roof-rail, seat frame, door beam, bumper beam, control arm, wheel, instrument panel reinforcement, running boards, roll-bar, tow hook, bumper hitch, roof rack.

13. The method of manufacturing an automotive structural member of claim 11 further comprising the steps of:

allowing the automotive structural member to reach equilibrium after hardening;

tempering the automotive structural member by heating the automotive structural member to between 150° C. and 650° C.; and allowing the automotive structural member to air cool to ambient temperatures.

14. The method of manufacturing an automotive structural member of claim 11 further comprising the steps of:

allowing the automotive structural member to reach equilibrium after hardening;

performing a low temperature tempering of the automotive structural member by heating the automotive structural member to between 130° C. and 180° C.; and allowing the automotive structural member to air cool to ambient temperatures.

15. The method of manufacturing an automotive structural member of claim 14 wherein the step of performing a low temperature tempering is accomplished during an electrocoating bake cycle.

* * * * *